US008353566B2

(12) United States Patent
Hendricks et al.

(10) Patent No.: US 8,353,566 B2
(45) **Date of Patent: *Jan. 15, 2013**

(54) PRINT BAR LIFT

(75) Inventors: Jeffrey T Hendricks, Camas, WA (US); Kenneth Williams, Vancouver, WA (US); Joseph E Scheffelin, Poway, CA (US); Dan Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 177 days.

This patent is subject to a terminal disclaimer.

(21) Appl. No.: 12/885,167

(22) Filed: Sep. 17, 2010

(65) Prior Publication Data

US 2012/0069089 A1 Mar. 22, 2012

(51) Int. Cl.
*B41J 25/308* (2006.01)

(52) U.S. Cl. ..... 347/8; 347/42

(58) Field of Classification Search ..... None
See application file for complete search history.

(56) References Cited

U.S. PATENT DOCUMENTS

2008/0238959 A1* 10/2008 Kato et al. ..... 347/8
2008/0309702 A1* 12/2008 Takahashi ..... 347/19
2009/0237443 A1 9/2009 Miramanda et al.

* cited by examiner

*Primary Examiner* — Matthew Luu
*Assistant Examiner* — Justin Seo
(74) *Attorney, Agent, or Firm* — Steven R. Ormiston

(57) ABSTRACT

In one embodiment, an assembly includes a lift and a print bar mounted to the lift. The lift includes first and second guide rods oriented parallel to one another and perpendicular to an axis of the print bar across the print zone. The first end of the print bar is slidably connected to the first guide rod, the second end of the print bar is slidably connected to the second guide rod, and the lift is configured to simultaneously move both ends of the print bar along the guide rods. In another embodiment, an assembly includes a chassis and a lift supported by the chassis. The lift is configured to loosely hold a print bar and to raise and lower the print bar over a print zone such that both ends of the print bar move simultaneously.

15 Claims, 15 Drawing Sheets

PRINT BAR LIFT

BACKGROUND

In some inkjet printers, a media wide arrangement of stationary printheads is used to print on paper or other print media moving past the printheads. Unlike scanning printheads, there is no scan axis along which these stationary page wide array (PWA) printheads may be moved to a service station. Thus, another technique is needed to bring the PWA printheads and the service station together.

DRAWINGS

FIG. 1 is a block diagram illustrating one example of an inkjet printer in which embodiments of the new print bar lift may be implemented.

FIGS. 2 and 3 are perspective views illustrating one example embodiment of a print bar lift installed in a chassis. FIG. 2 shows a print bar supported in the lift. The print bar is omitted from FIG. 3.

FIGS. 4 and 5 are perspective and side elevation views, respectively, and FIGS. 6 and 7 are elevation end views, illustrating the print bar lift of FIGS. 2 and 3 in more detail.

Figure 15:
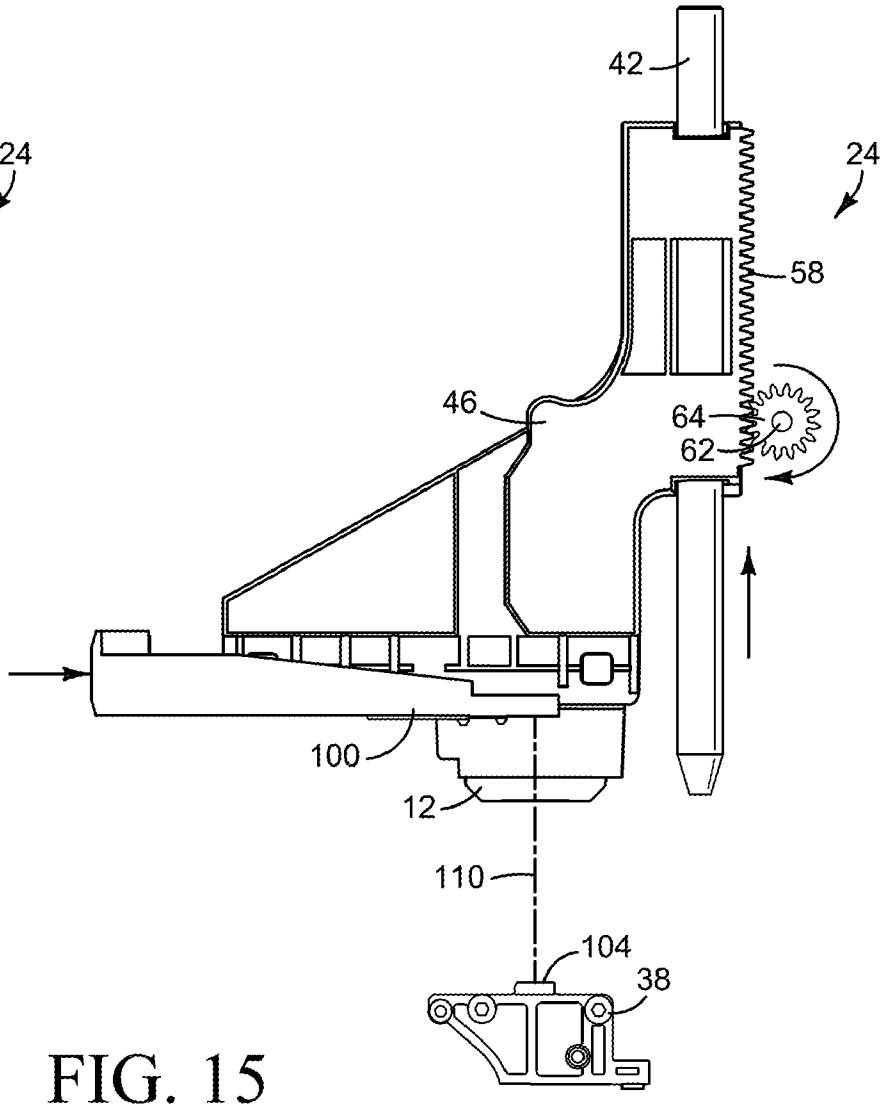
Figure 14:
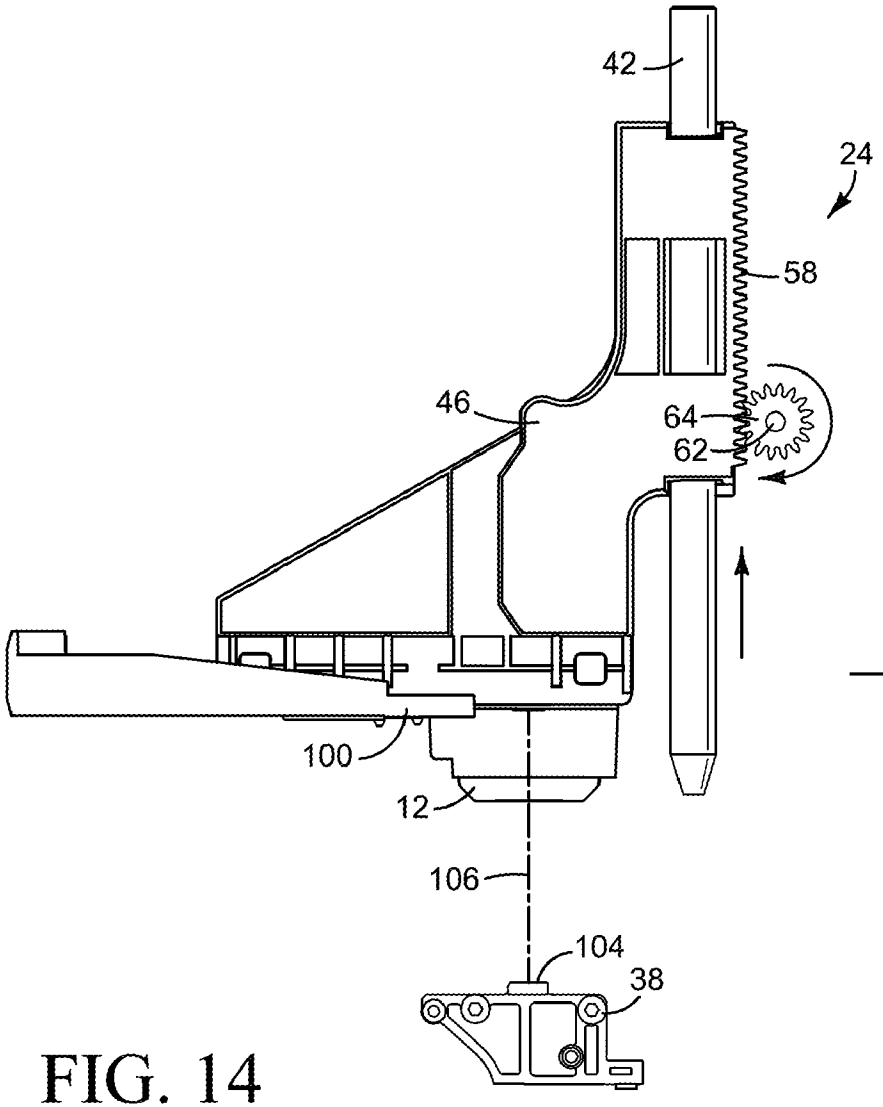
Figure 17:
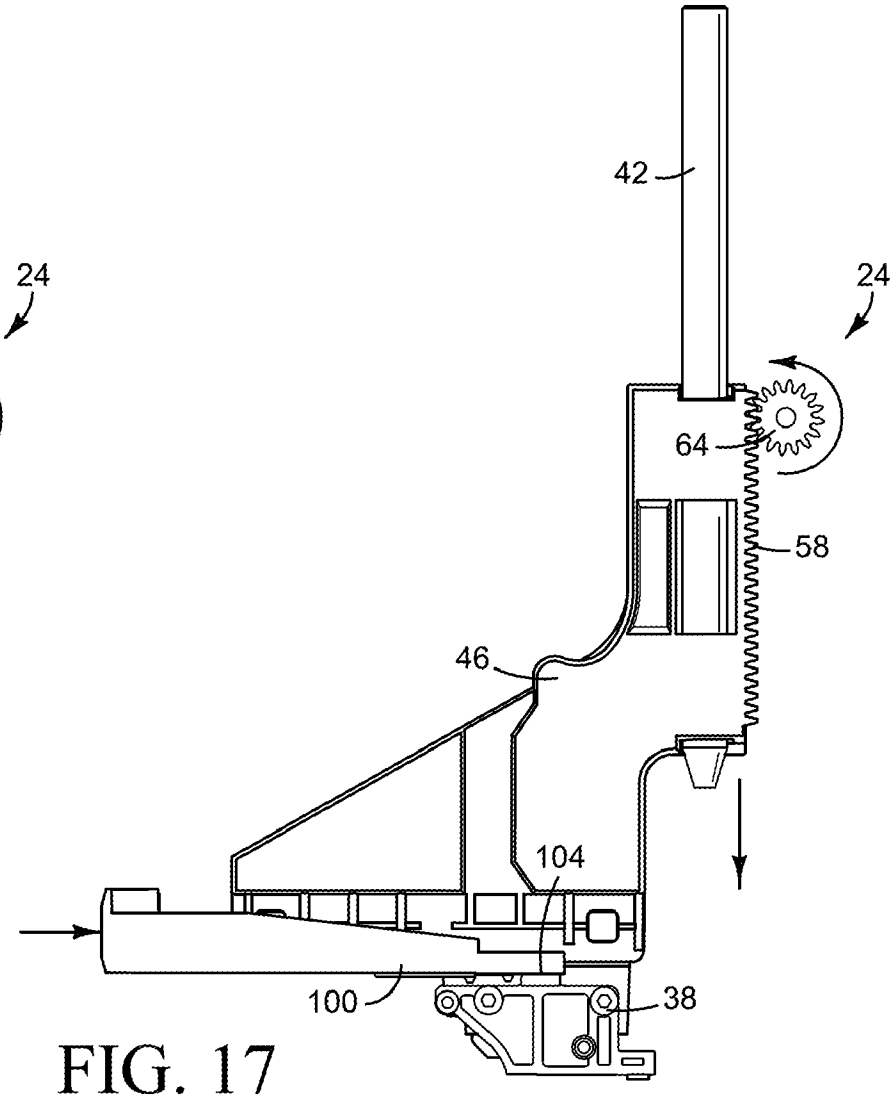
Figure 16:
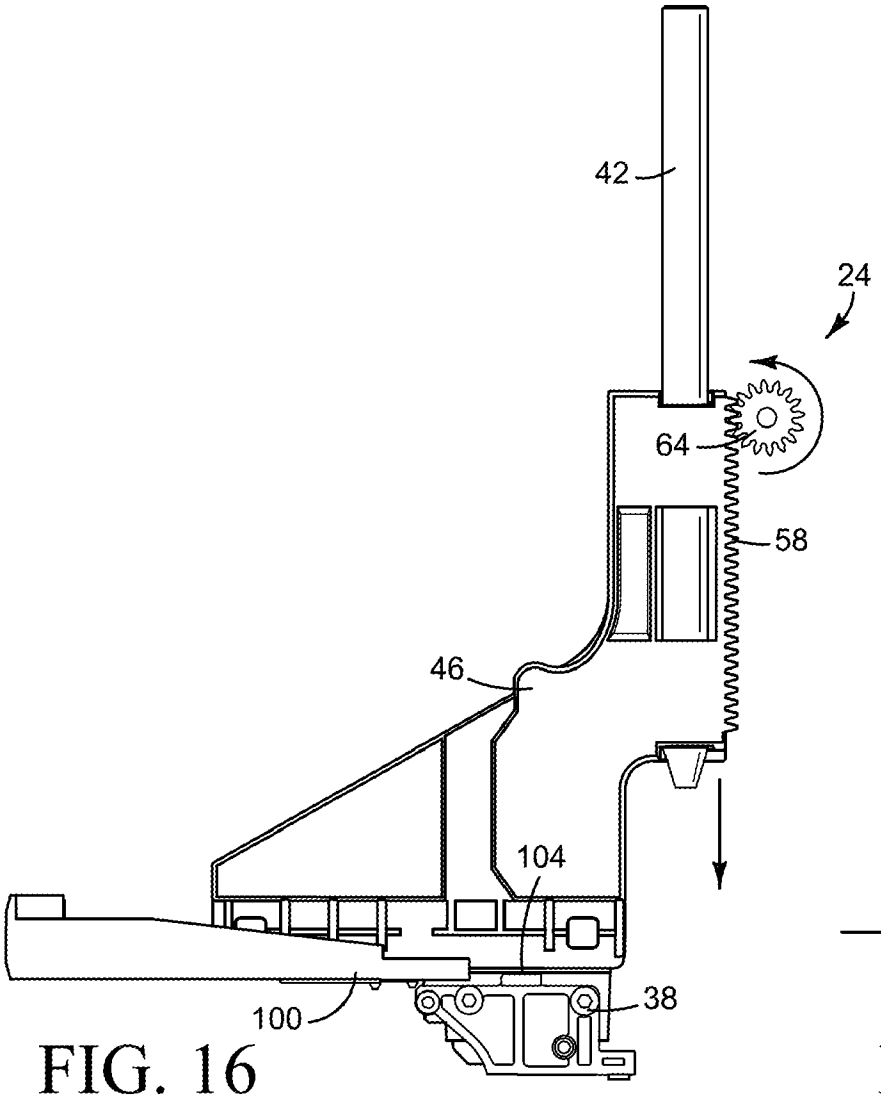
Figure 18:
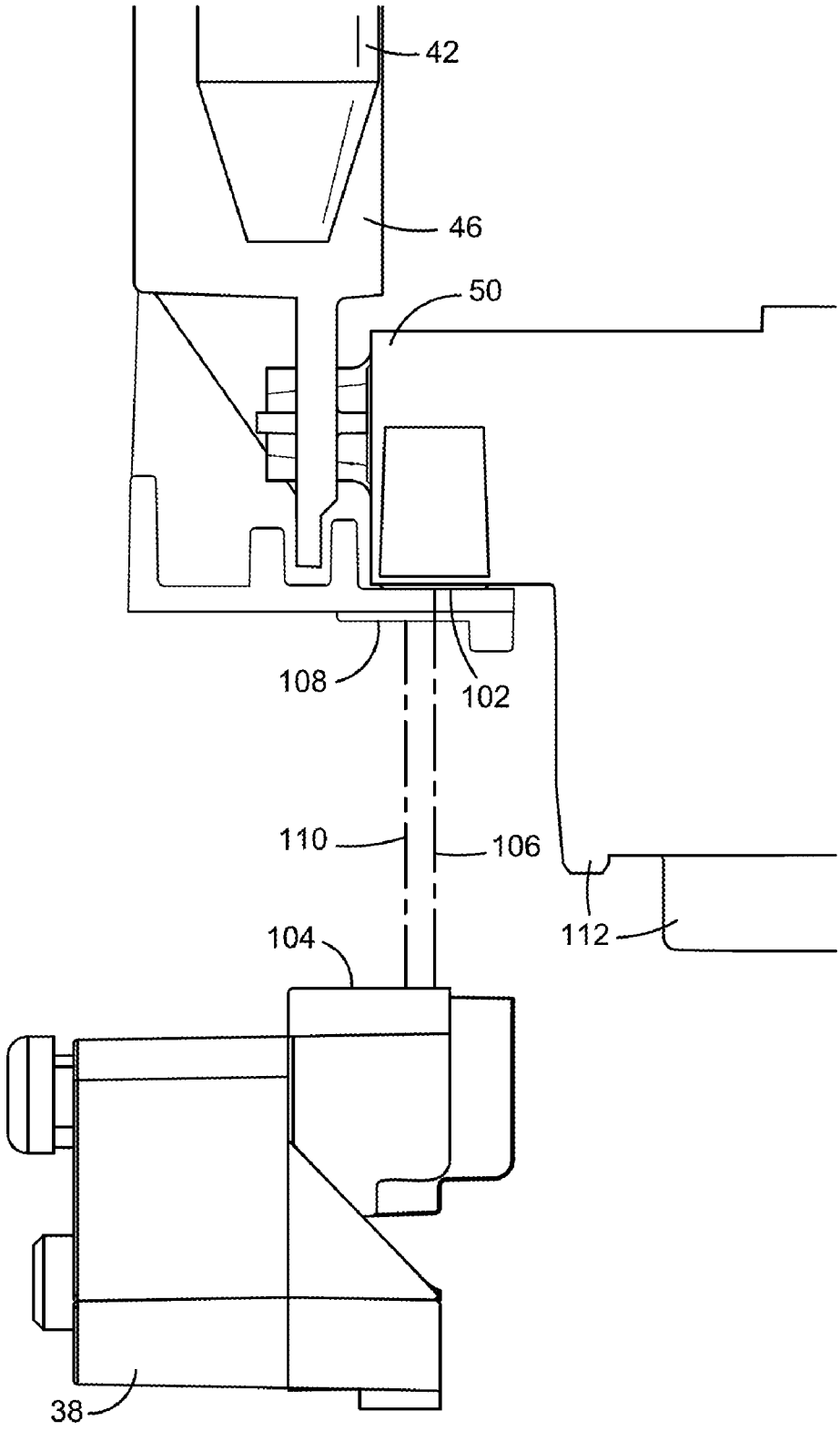

FIGS. 14-18 illustrate one example sequence of operation of the print bar lift shown in FIGS. 2-5. FIGS. 14 and 16 show the lift in a raised, servicing position and in a lowered, printing position, respectively. FIGS. 15 and 17 show the lift in a raised, servicing position and in a lowered, printing position, respectively, with an optional spacer for a larger printhead to platen spacing. FIG. 18 is a more detailed view showing the areas of contact between a stop and the print bar.

The same part numbers are used to designate the same or similar parts throughout the figures.

DESCRIPTION

Embodiments of the new print bar lift were developed to facilitate servicing stationary PWA printheads. (Stationary in this context means that the printheads and the print bar holding the printheads remain stationary during printing.) In one example embodiment, the print bar is constrained in the correct printing position but "floats" on loose connections when raised to a servicing position, to reduce the risk of binding on the lift guide rods even when using a lower cost, light duty drive train. In one example embodiment, the lift is configured to simultaneously move both ends of the print bar along the guide rods. Embodiments of the new lift are not limited PWA printheads. The embodiments shown in the figures and described below are non-limiting, example embodiments. Other embodiments are possible and nothing in the following description should be construed to limit the scope of the disclosure, which is defined in the Claims that follow this Description.

Although embodiments of the new print bar lift are not necessarily limited to printers dispensing ink or other liquids, and may be used for devices dispensing other fluids, inkjet printheads generally are not practical for dispensing fluids composed primarily of gas(es). Thus, "liquid" as used in this document means a fluid not composed primarily of a gas or gases.

A "printhead" as used in this document refers to that part of an inkjet printer or other type of inkjet drop dispenser that expels drops of liquid from one or more openings, including what is commonly referred to as a printhead die, a printhead die assembly and/or a printhead die carrier assembly. A "print bar" as used in this document means a structure or device holding an arrangement of printheads that remains stationary during printing. "Printhead" and "print bar" are not limited to printing with ink but also include inkjet type dispensing of other liquids and/or for uses other than printing.

In this document, "parallel" and "perpendicular" mean substantially parallel and substantially perpendicular. Therefore, small misalignment due to loose connections is included within the definition of each of these terms.

The translational and rotational degrees of freedom of a print bar and parts of a print bar lift are described with reference to X, Y and Z axes, where the X axis extends in a direction laterally across a print zone perpendicular to the direction the print media moves through the print zone, the Y axis extends in a direction parallel to the direction the print media moves through the print zone, and the Z axis is perpendicular to the X and Y axes. Theta X refers to rotation about the X axis, theta Y refers to rotation about the Y axis, and theta Z refers to rotation about the Z axis.

Figure 1:
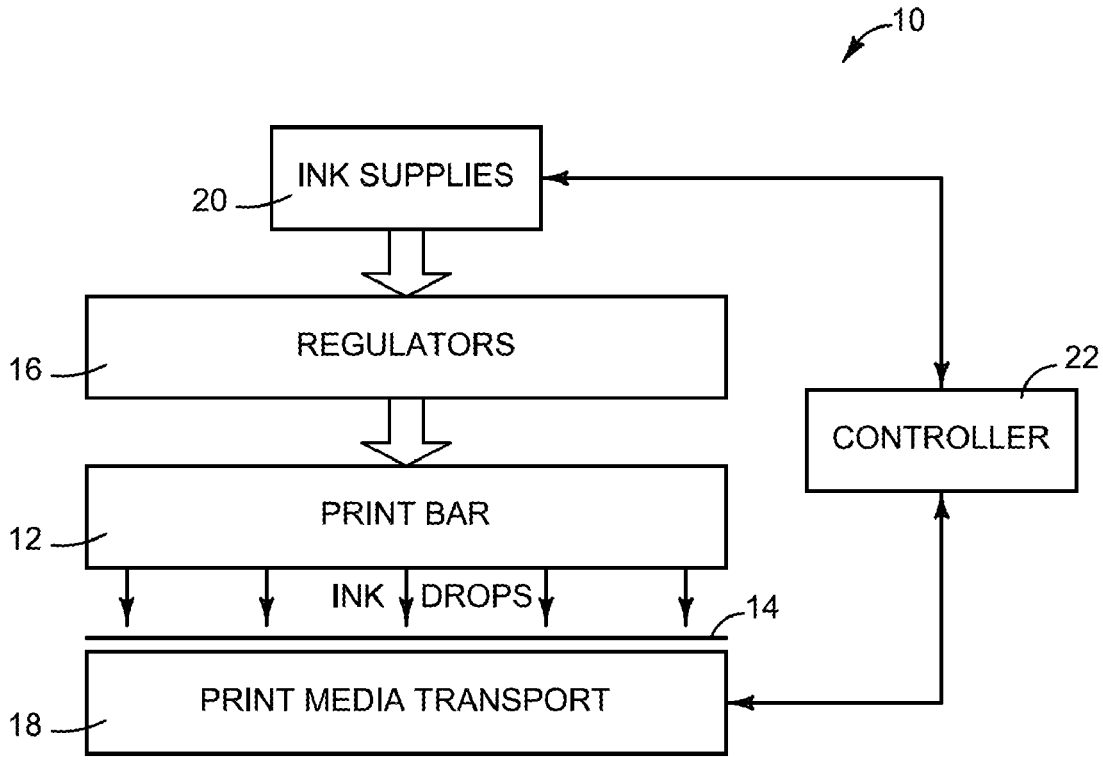

FIG. 1 is a block diagram illustrating one example of an inkjet printer in which embodiments of the new print bar lift may be implemented. Referring to FIG. 1, an inkjet printer 10 includes a print bar 12 spanning the width of a print media 14. Printer 10 also includes flow regulators 16 associated with print bar 12, a media transport mechanism 18, ink supplies 20, and an electronic printer controller 22. Print bar 12 in FIG. 1 includes an arrangement of multiple printheads for ejecting drops of ink on to a sheet or continuous web of paper or other print media 14. Each printhead is electrically connected to printer controller 22, typically through a flexible circuit tape holding multiple electrical conductors. Each printhead is fluidically connected to one or more ink supplies 20 through a typically complex ink flow path in print bar 12 and through flow regulators 16. In operation, printer controller 22 selectively energizes ink ejector elements in a printhead, or group of printheads, in the appropriate sequence to eject ink on to media 14 in a pattern corresponding to the desired printed image. Controller 22 in FIG. 1 represents generally the programming, processor(s) and associated memories, and the electronic circuitry and components needed to control the operative elements of a printer 10.

Figure 2:
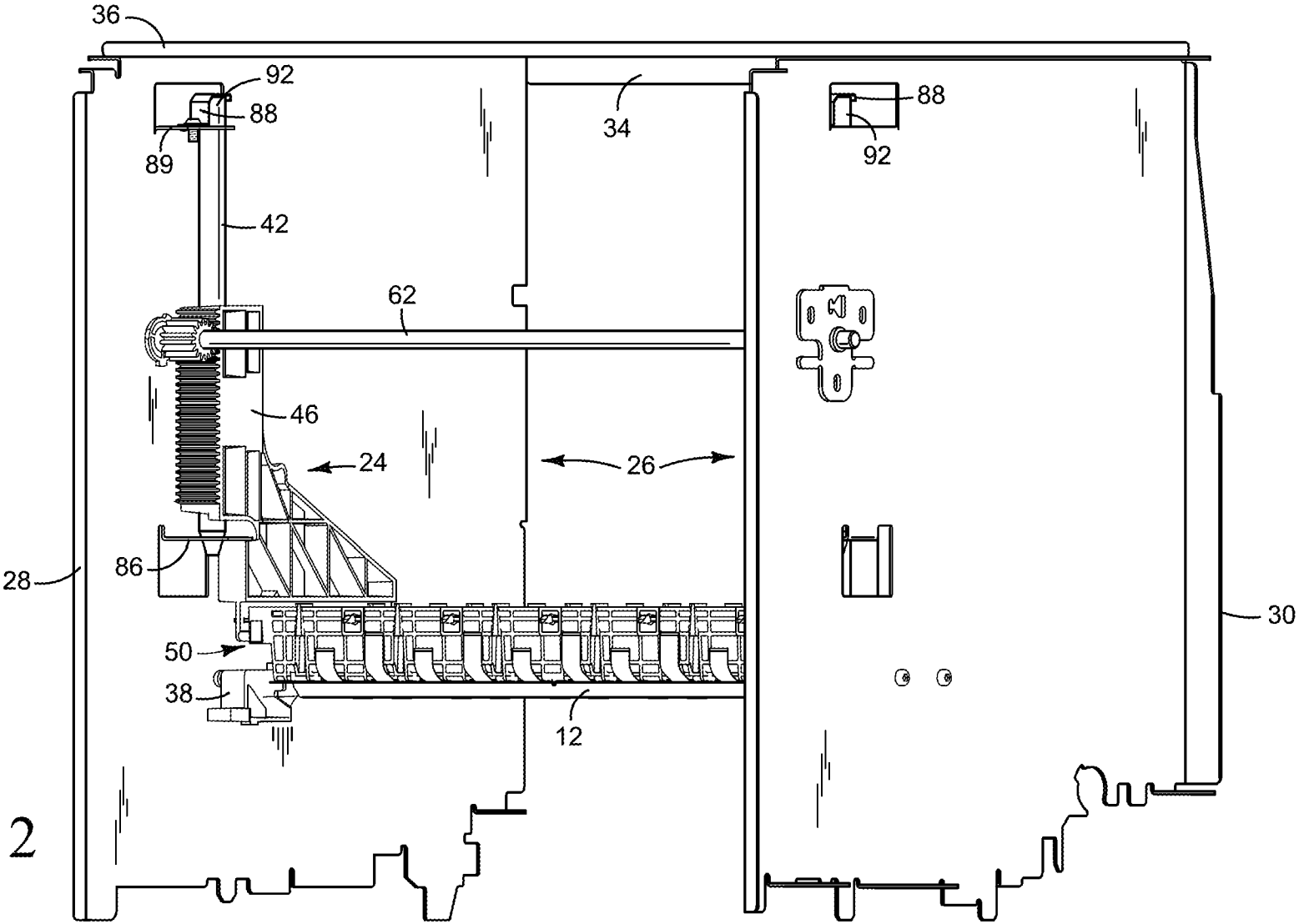
Figure 3:
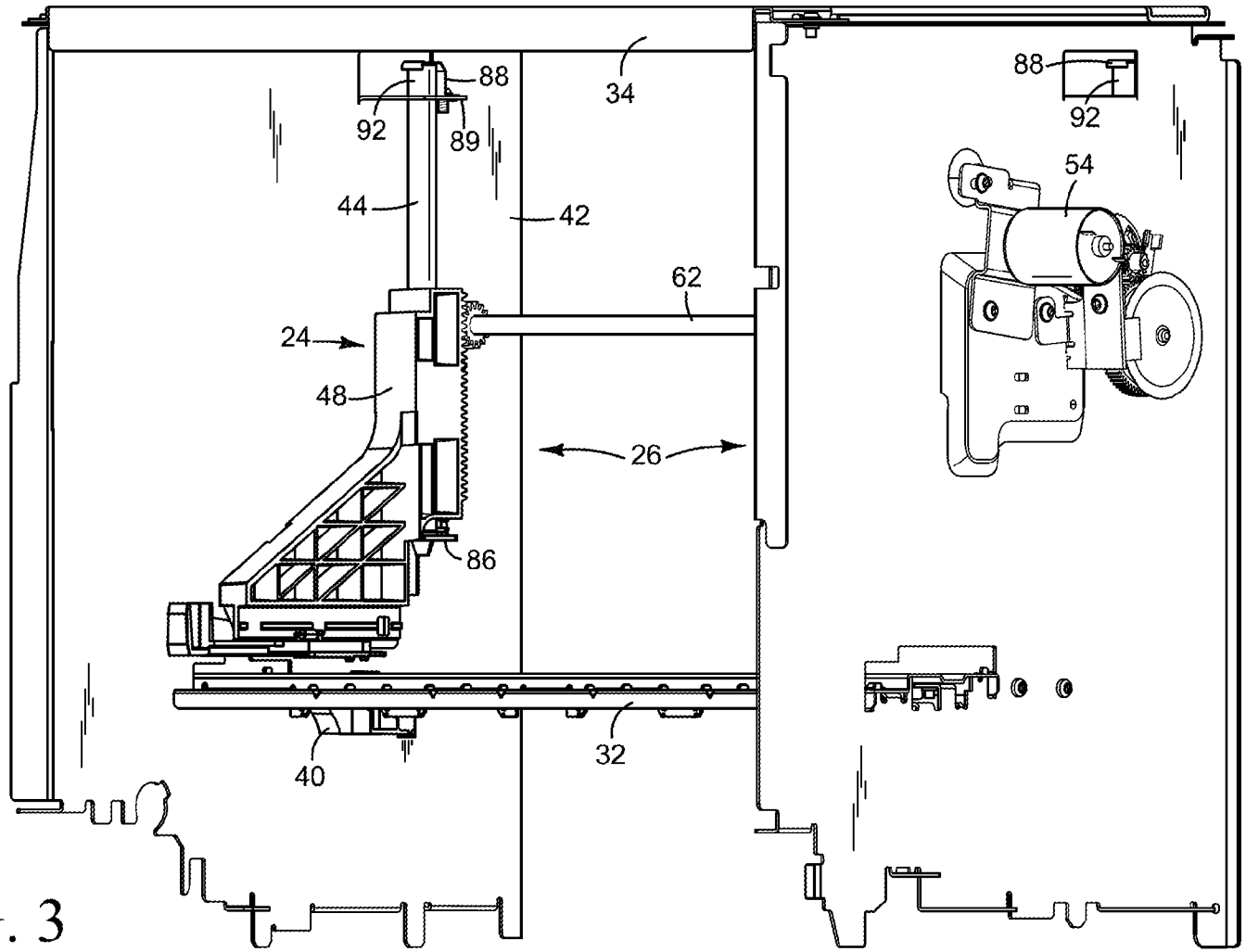
Figure 4:
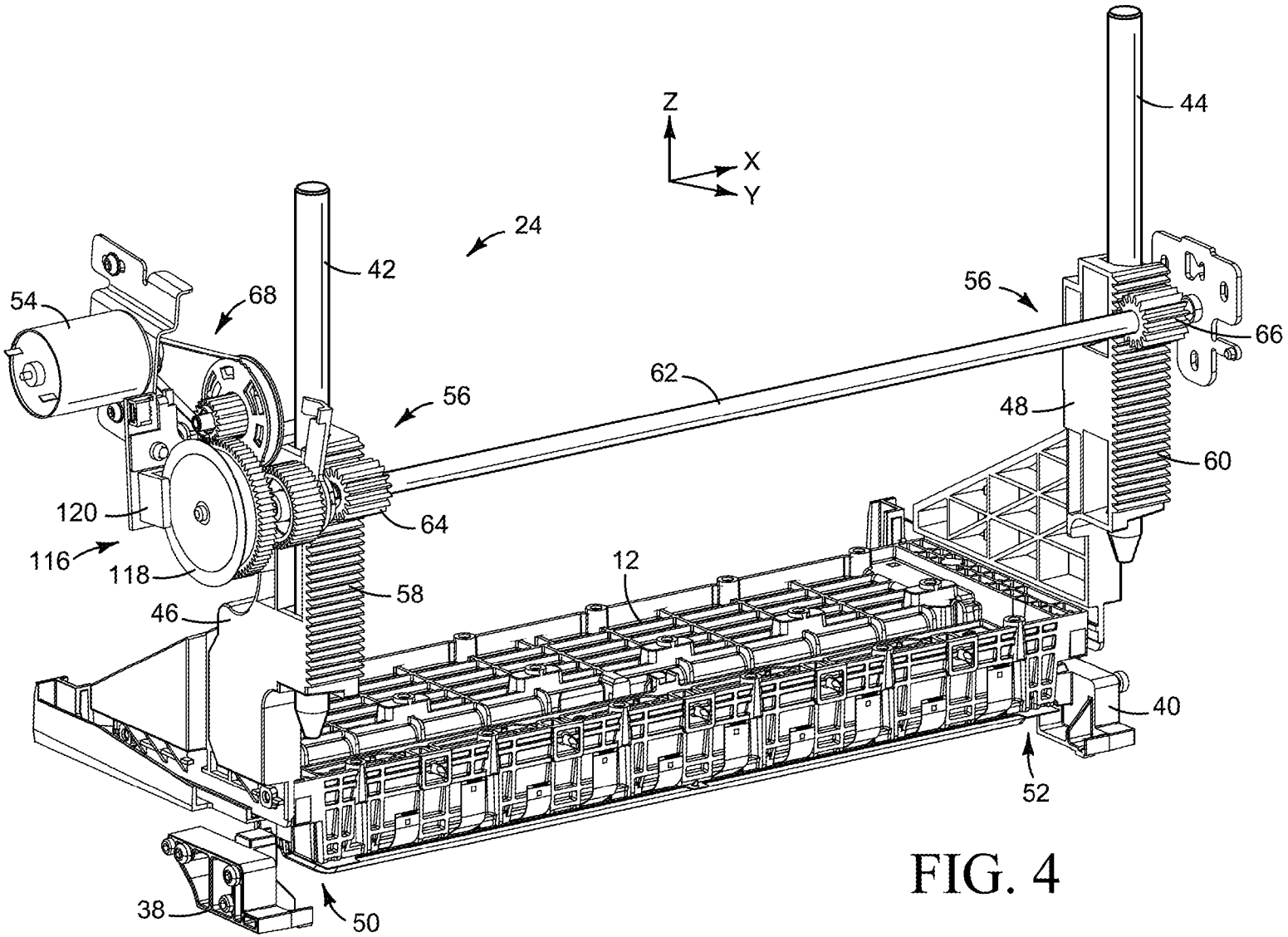
Figure 5:
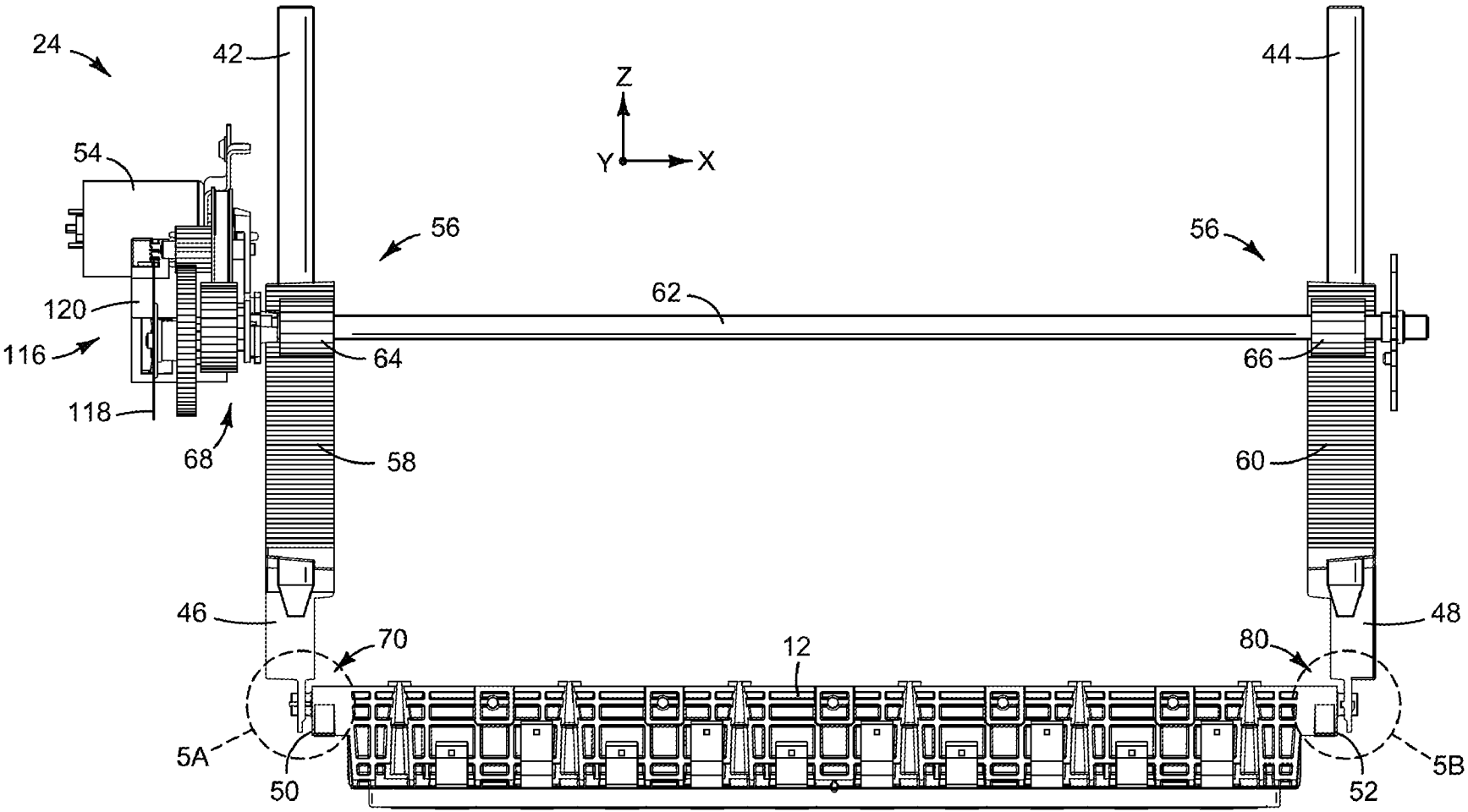
FIGS. 5A and 5B are detail views taken from FIG. 5.
Figure 7:
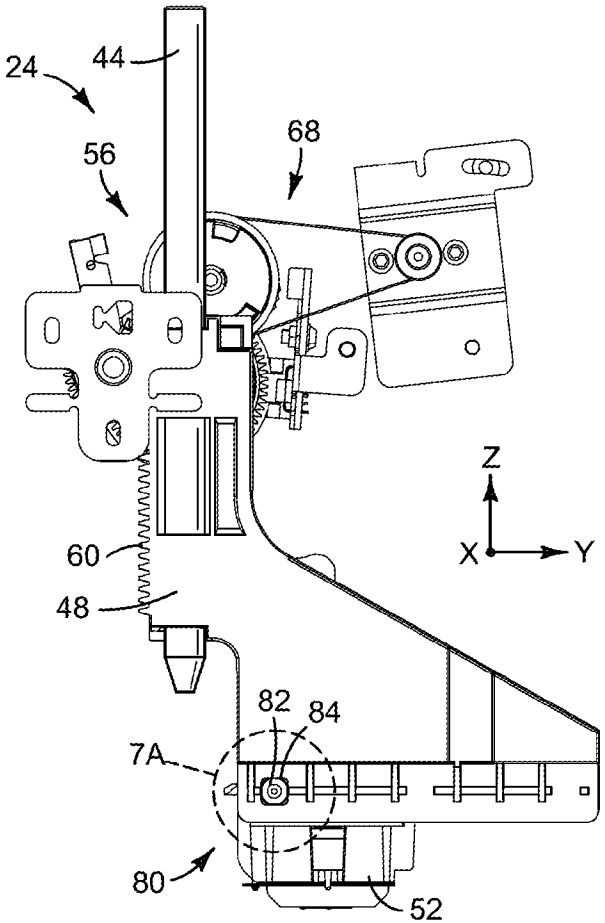
FIG. 7A is a detail view taken from FIG. 7 illustrating one example embodiment of the connection between the print bar and the print bar lift shown in FIGS. 2-5.
Figure 6:
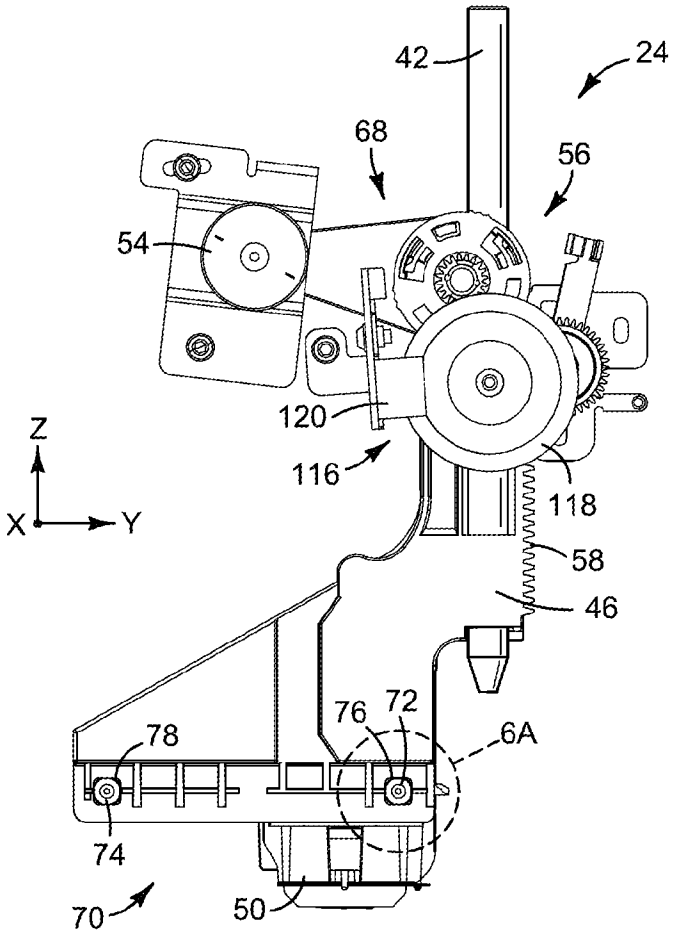
FIG. 6A is a detail view taken from FIG. 6.

FIGS. 2 and 3 are perspective views illustrating one example embodiment of a print bar lift 24 mounted in a chassis 26. FIG. 2 shows a print bar 12 supported in lift 24. Print bar 12 is omitted from FIG. 3 to better illustrate other parts. FIGS. 4 and 5 are perspective and side elevation views, respectively, and FIGS. 6 and 7 are elevation end views, illustrating print bar lift 24 in more detail.

Referring first to FIGS. 2 and 3, chassis 26 represents generally a stationary structure (relative to print bar 12) for supporting lift 24 in a printer 10 (FIG. 1). In the embodiment shown, chassis 26 is constructed as a sheet metal frame that includes side panels 28, 30 and struts 32, 34, 36 extending between side panels 28, 30. Chassis 26, for example, may be part of a single integrated printer chassis or one component of a multi-component printer chassis. Chassis 26 also supports a pair of stationary stops 38 and 40 mounted opposite one another on side panels 28 and 30, respectively. As described in more detail below, print bar 12 lands on stops 38 and 40 to help properly position print bar 12 for printing.

Referring now also to FIG. 4-7, lift 24 includes a pair of guide rods 42, 44 and a corresponding pair of lift brackets 46, 48 that slide along guide rods 42, 44. Each guide rod 42, 44 is mounted to a corresponding side panel 28, 30 of chassis 26 as shown in FIGS. 2 and 3. Mounting details for guide rods 42, 44 in chassis 26 are described below with reference to FIG. 10. Print bar 12 is supported by lift brackets 46, 48 at each end 50, 52. Lift 24 also includes a motor 54 connected to each lift bracket 46, 48 through a transmission 56. In the example embodiment shown in FIGS. 2-7, transmission 56 includes a rack 58, 60 on each lift bracket 46, 48, a pinion shaft 62 carrying pinions 64, 66 that simultaneously engage racks 58, 60, respectively, and a drive train 68 coupled between motor 54 and pinion shaft 62. Drive train 68 represents generally any suitable mechanism for transmitting the desired motive force from motor 54 to shaft 62.

To reduce the risk of brackets 46, 48 binding on guide rods 42, 44 when raising and lowering print bar 12, while still allowing print bar 12 to be properly positioned for printing, print bar 12 is loosely connected to lift brackets 46, 48 in some degrees of freedom but tightly connected in other degrees of freedom. This mounting scheme allows for the vertical translation of a page wide printbar 12 along guide rods 42, 44 without precisely aligning rods 42, 44 in a parallel orientation. Binding and over constraint conditions may be minimized by managing each degree of freedom, X, Y, Z and theta X, theta Y, and theta Z even when using lower cost, light duty lift and transmission components. Print bar 12, however, must be constrained when print bar 12 is in the printing position for proper printhead to media spacing and alignment. Stops 38 and 40 (FIGS. 2-4) affixed to chassis 26 (FIGS. 2 and 3) define the lower limit of travel, and constrain print bar 12 in the correct printing position parallel to and properly spaced from the print platen as shown in FIGS. 8 and 9.

One example embodiment for the print bar, lift bracket and guide rod connections will now be described with reference to FIGS. 5-13. In this embodiment, as detailed below, the connections between lift brackets 46, 48 and guide rods 42, 44 constrain each bracket 46, 48 in X, Y, theta X and theta Y. Stops 38, 40 constrain print bar 12 in Z and theta Y (when print bar 12 is lowered onto stops 38, 40). Thus, two systems are competing to constrain print bar 12 in theta Y—rods 42, 44 acting through brackets 46, 48 and stops 38, 40. Because theta Y is an important print zone control, effecting ink drop flight distance (along with Z and theta X), the more accurate vertical motion stops 38, 40 are used exclusively to constrain theta Y. Consequently, the theta Y constraint attempted by lift rods 42, 44 is neutralized by allowing each end of print bar 12 to pivot in theta Y at the connection with lift brackets 46, 48. Similarly, the connections between rod 42, 44 and the corresponding lift bracket 46, 48 are competing to constrain theta X. The theta X constraint attempted by one of the rod/bracket connections 44/48 is neutralized by allowing the lift bracket to pivot in theta X at the connection with print bar 12.

Figure 5B:
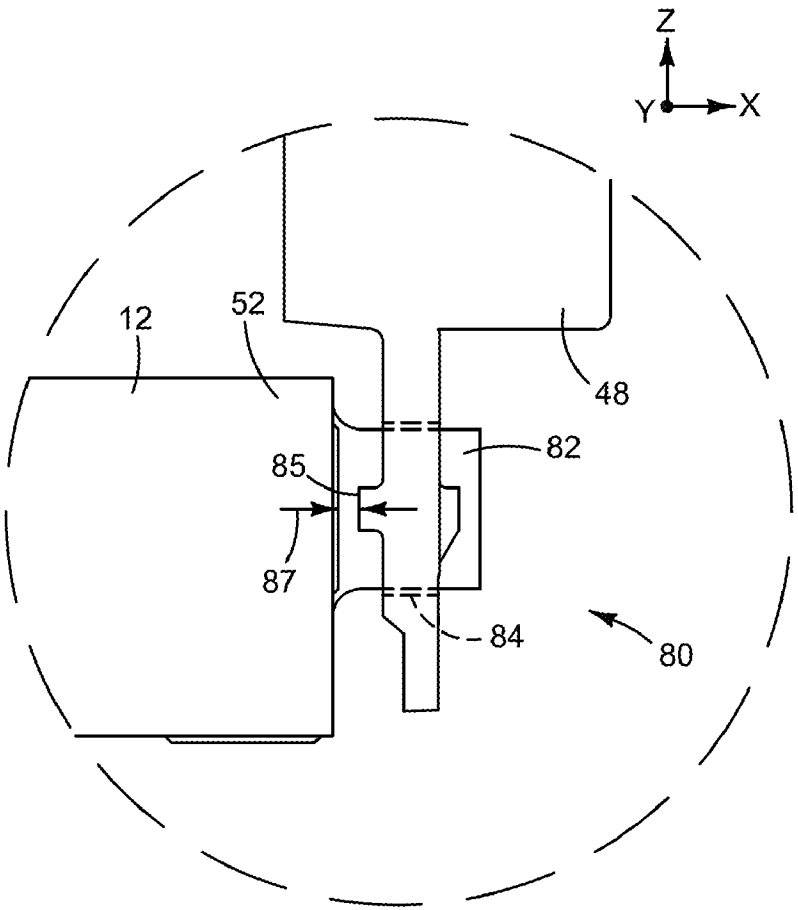
Figure 5A:
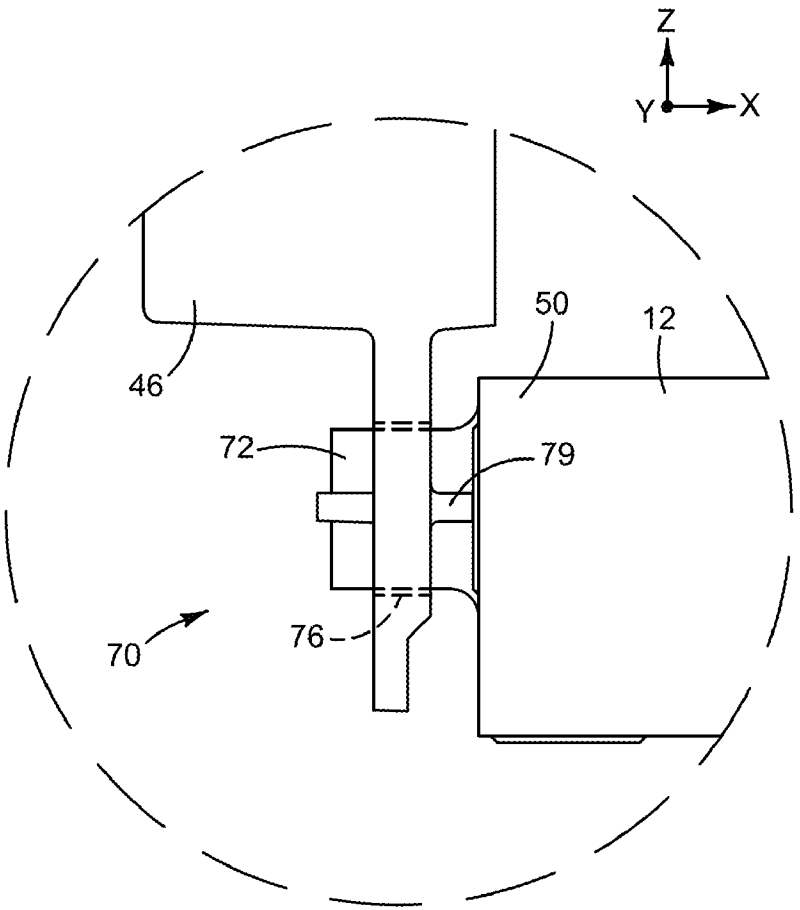
Figure 6A:
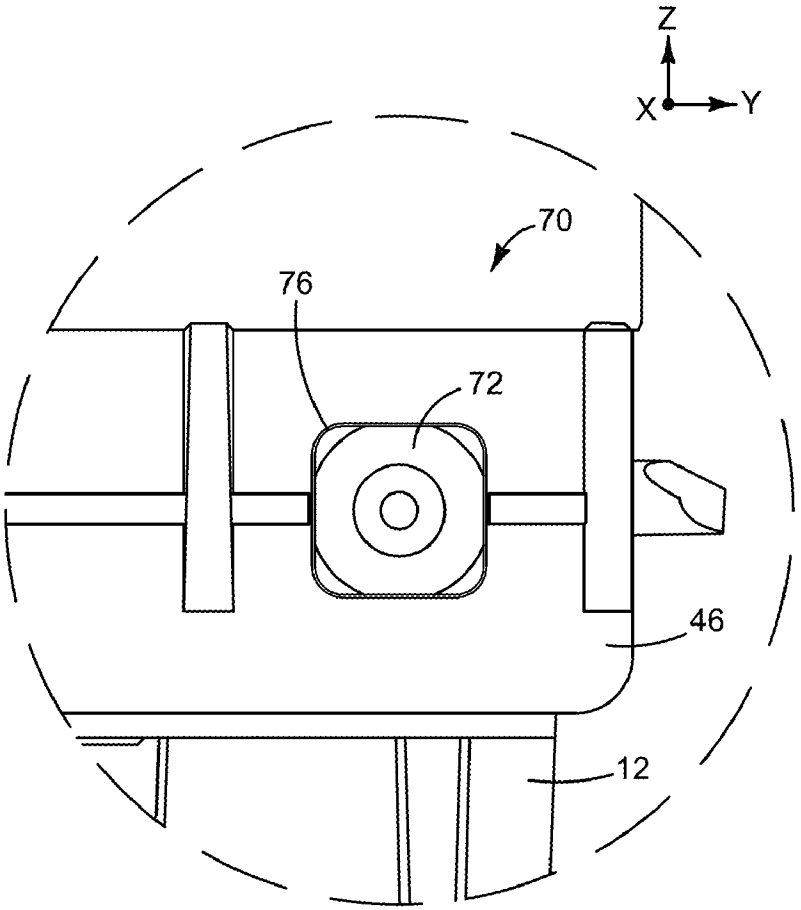
Figure 8:
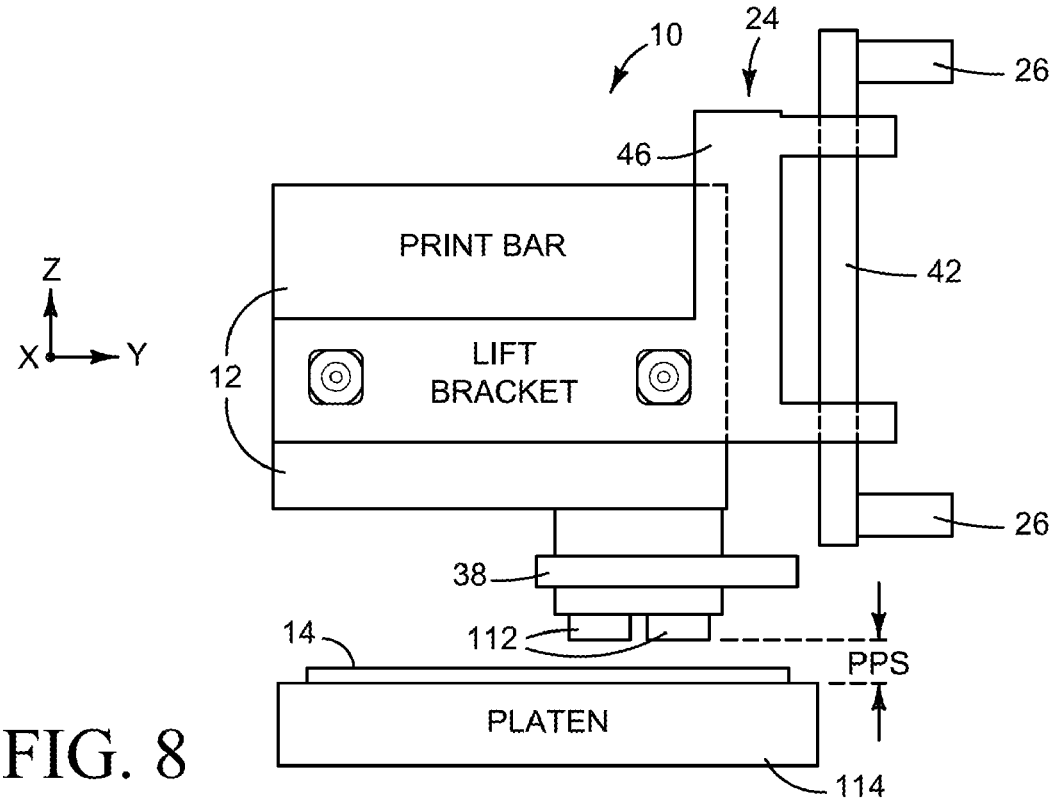
FIGS. 8 and 9 are schematic end views illustrating one example embodiment for the position of a print bar and print bar lift such as that shown in FIGS. 2-5 installed in a printer.

Referring first to FIGS. 6, 6A and 8, print bar first end 50 is constrained with respect to lift bracket 46 at a first lift bracket connection 70 in Y, Z and theta X with two pins 72, 74 protruding from print bar end 50 into mating holes 76, 78 in first lift bracket 46. The use of two pin/holes 72/76 and 74/78 spaced apart in the Y direction constrains print bar 12 in theta X. Each pin/hole connection 72/76, 74/78 constrains print bar 12 in Y and Z. In the example embodiment shown in FIG. 6, round pins 72, 74 with flats fit into square holes 76, 78. Other suitable pin/hole configurations may be used. Referring now to FIG. 5A, print bar first end 50 is constrained in X by a rib 79 protruding from bracket 46 and abutting print bar end 50. Rib 79 is narrow in Z to allow print bar first end 50 freedom in theta Y. Ribs 79 spaced apart along Y at each pin/hole connection also constrain print bar first end 50 in theta Z.

Figure 7A:
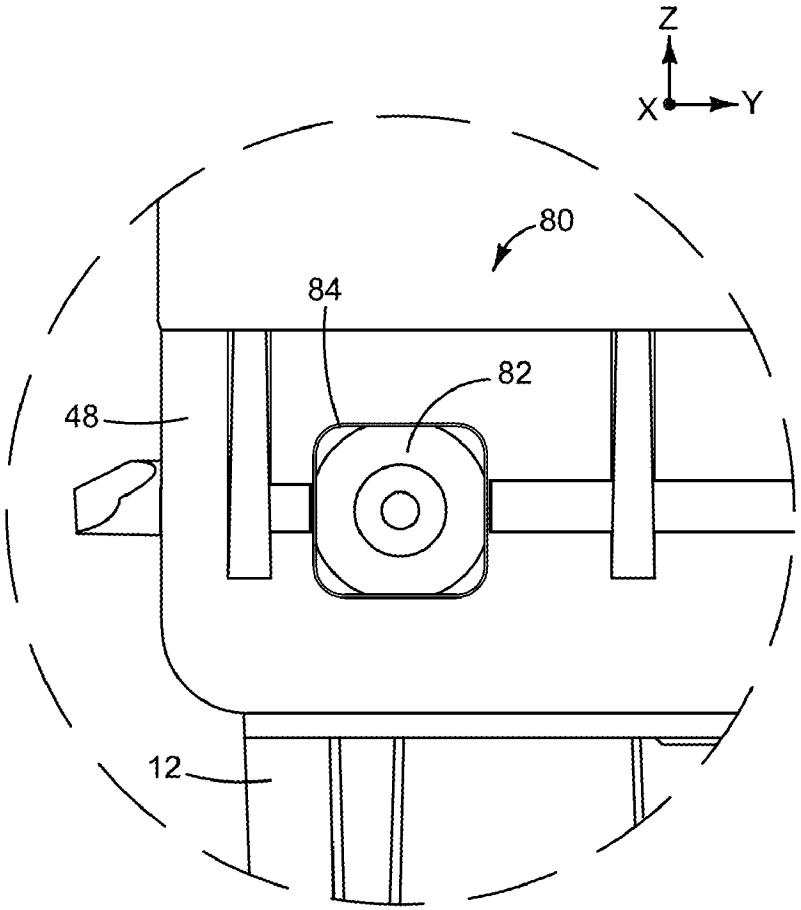
Figure 9:
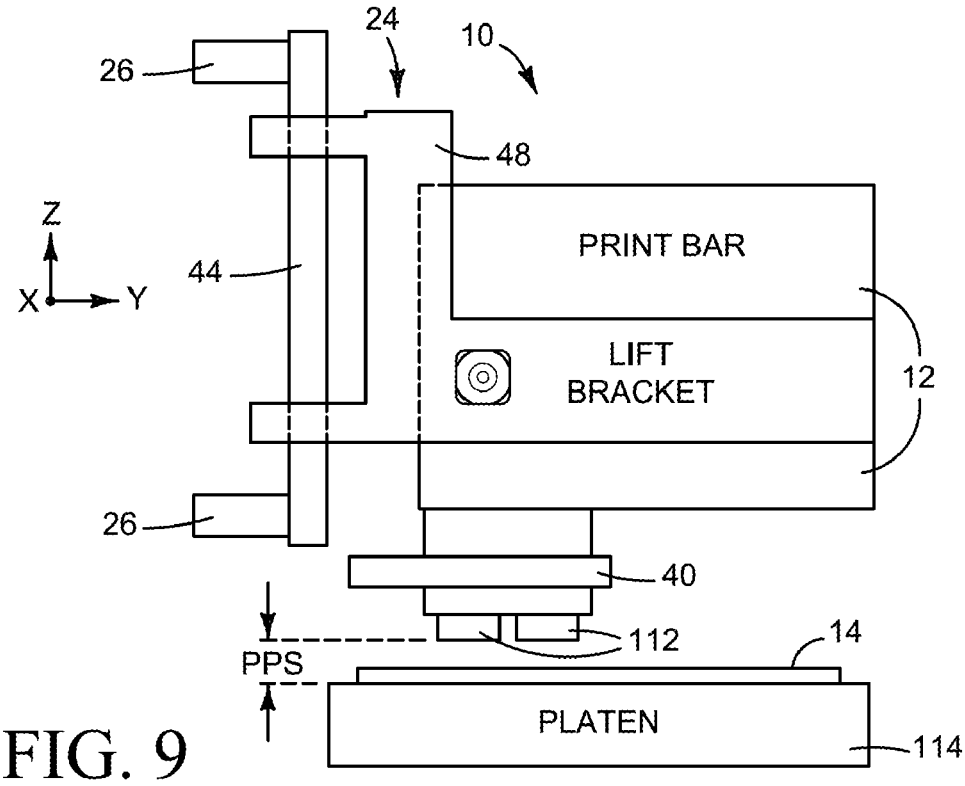

Referring to FIGS. 7, 7A and 9, print bar second end 52 is connected to second lift bracket 48 at a single pin connection 80. A pin 82 protruding from print bar second end 52 fits into a mating hole 84 in second lift bracket 48. The single pin/hole connection 80 constrains print bar second end 52 in Y and Z with respect to bracket 48 but allows freedom in theta X. Referring to FIG. 5B, for second end connection 80, a shortened rib 85 leaves a gap 87 between print bar second end 52 and second lift bracket 48, allowing print bar second end 52 freedom in X. The connections between rod 42, 44 and the corresponding lift bracket 46, 48 are competing to constrain X. The X constraint attempted by rod/bracket connection 44/48 is neutralized by allowing print bar second end 52 this freedom in X.

Print bar ends 50, 52 may be secured to lift brackets 46, 48 by screws or other suitable fasteners at each pin/hole connection 72/76, 74/78 and 82/84. Screw holes are shown in the ends of pins 72 and 82 in FIGS. 6A and 7A but screws are not shown in the figures to avoid obscuring the alignment features at each connection.

Figure 10:
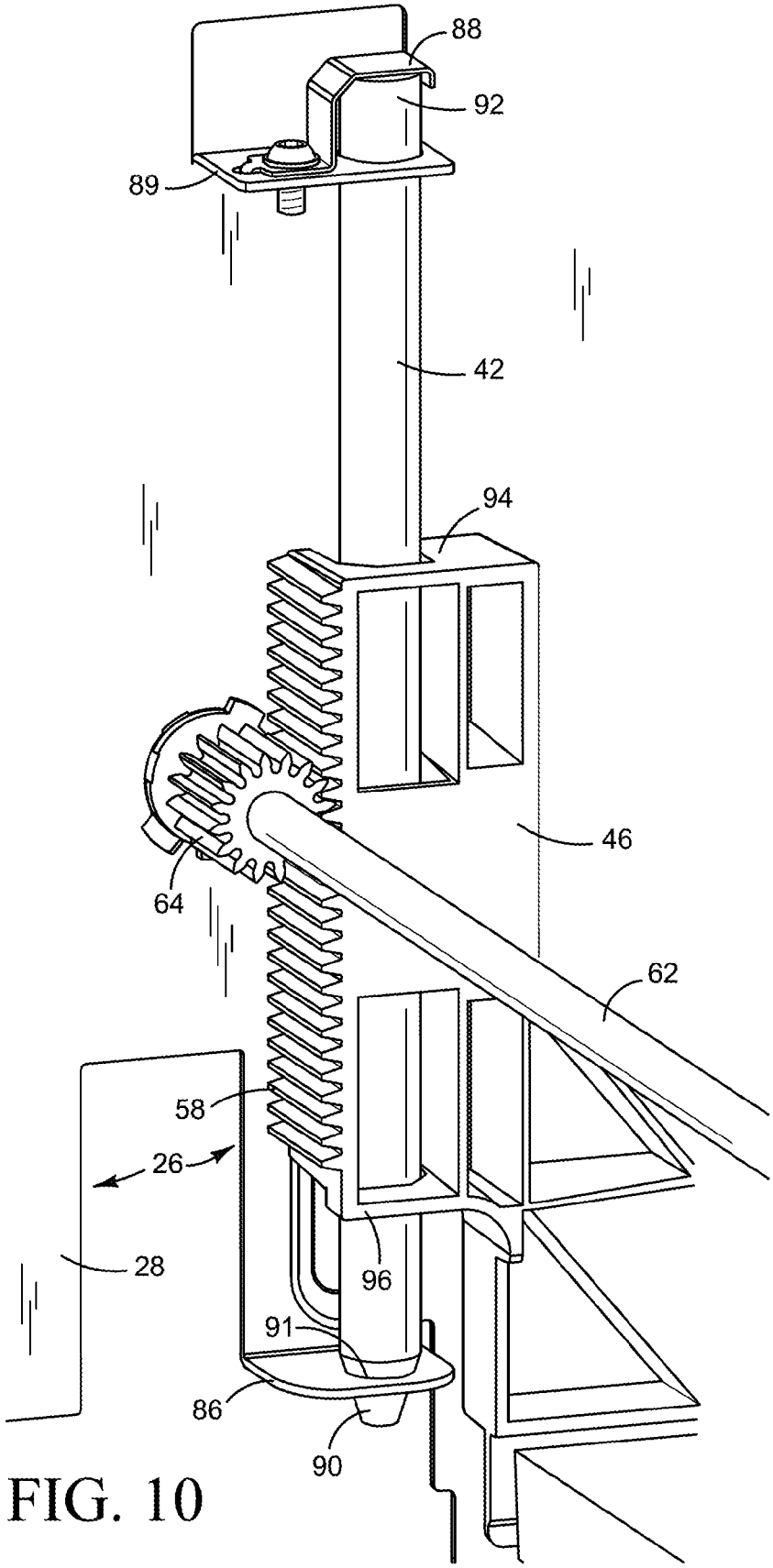
FIG. 10 is a detail perspective view showing one example embodiment for mounting the lift guide rods to the chassis.
Figure 11:
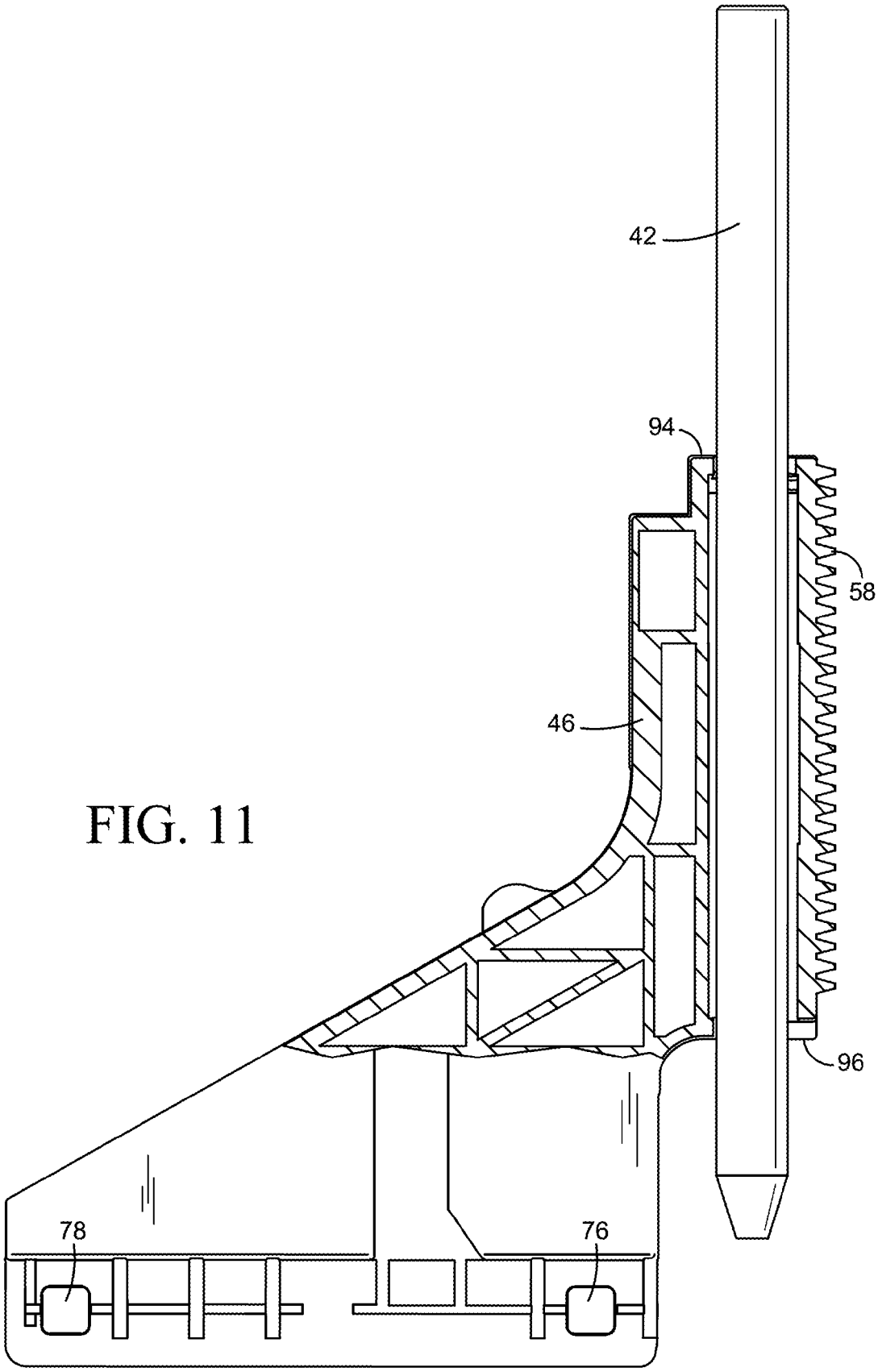
FIG. 11 is an elevation view.
Figure 13:
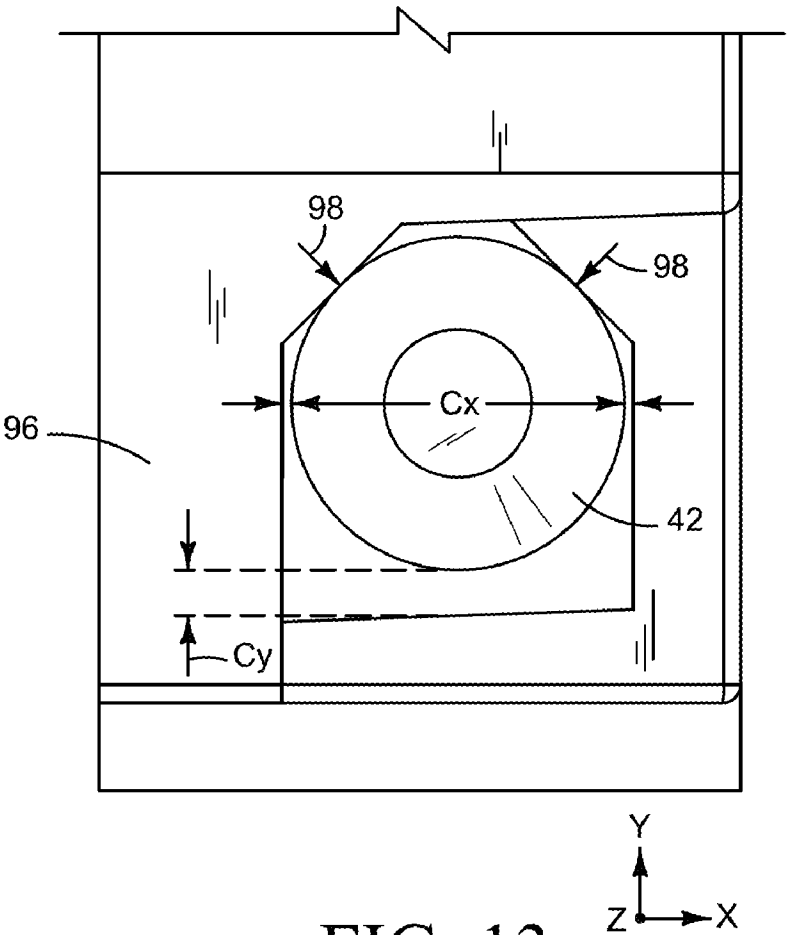
FIGS. 12-13 are plan views showing one example embodiment for mounting the lift brackets to the guide rods in the print bar lift of FIGS. 2-5.
Figure 12:
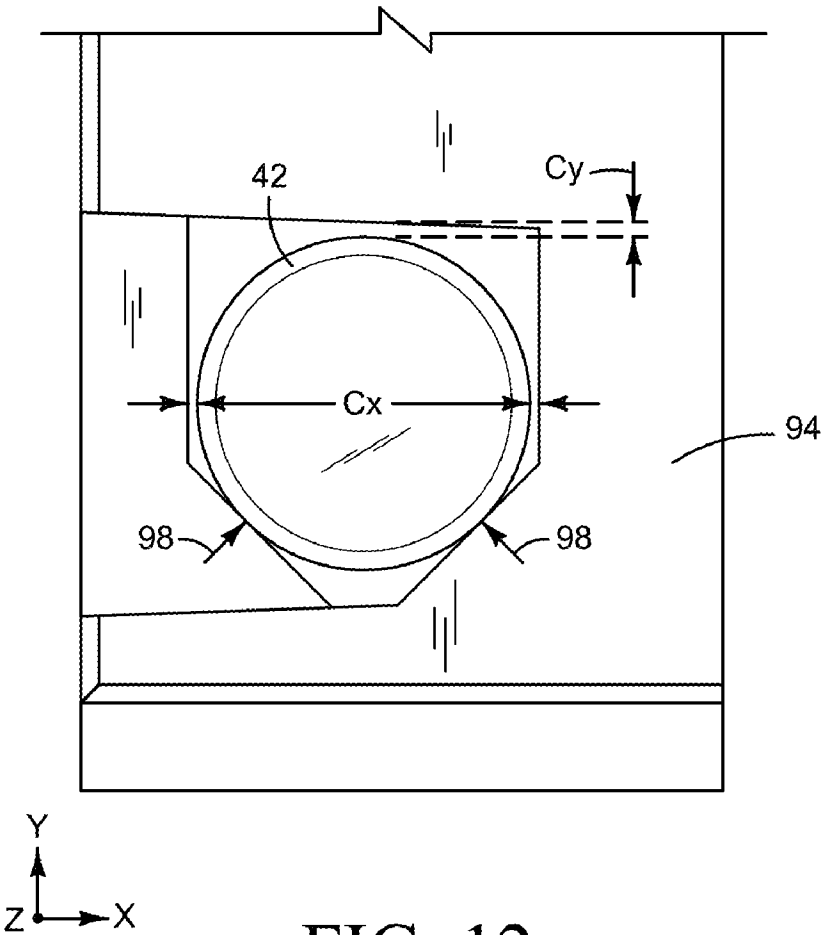

The mounting details for guide rods 42, 44 in chassis 26 and for lift brackets 46, 48 on guide rods 42, 44 will now be described with reference to FIGS. 10-13. FIG. 10 shows one example embodiment for mounting lift guide rods 42, 44 to chassis 26. FIGS. 11-13 show one example embodiment for mounting lift brackets 46, 48 to guide rods 42, 44.

Referring to FIG. 10, each guide rod 42, 44 is mounted to chassis 26 with a lower, rigid mounting tab 86, a spring tab 88, and an upper, rigid mounting tab 89. The mounting for guide rod 42 is shown in FIG. 10. The mounting for guide rod 44 on the opposite side of lift 24 is the same as that shown for guide rod 42. In the example embodiment shown, mounting tabs 86 and 89 are pressed out of a sheet metal chassis side panel 28. A tapered lower end 90 of guide rod 42 fits into a hole 91 in rigid tab 86. The upper end 92 of guide rod 42 snaps in under spring tab 88 to press lower rod end 90 down into hole 91 in tab 86, constraining guide rod 42 in X, Y and Z. Although other suitable mounting configurations are possible, the configuration shown allows for an easy and secure assembly of guide rod 42 into chassis 26.

FIG. 11 is an elevation and partial section view showing the connection between first lift bracket 46 and first guide rod 42. FIG. 12 is a plan view looking down on the top of lift bracket 46 on guide rod 42. FIG. 13 is a plan view looking up at the bottom of lift bracket 46 on guide rod 42. The mounting of second lift bracket 48 on second guide rod 44 is the same as that shown in FIGS. 11-13. As shown in FIG. 12, a top retainer part 94 of bracket 46 is beveled on one side in the Y direction in a truncated V shape. As shown in FIG. 13, a bottom retainer part 96 of bracket 46 is beveled on the other side in the Y direction in a truncated V shape. The weight of print bar 12 and its cantilever positioning extending out in the Y direction creates a torque on lift bracket 46 in theta X that holds lift bracket 48 in contact with guide rod 44 at the V shaped top 94 and at the V shaped bottom part 96, as shown in FIGS. 12 and 13 at contact arrows 98. That is to say, the weight and position of print bar 12 automatically "preloads" guide rod 42 into the V shaped retainer parts of bracket 46 to prevent lift bracket 46 from rocking back and forth on guide rod 42 when print bar 12 is raised and lowered. Clearances $C_X$ and $C_Y$ between the inside dimension of lift bracket 46 and outside dimension of guide rod 42 help reduce the risk of bracket 46 binding on rod 42. The small bearing surface contact between lift bracket 48 and guide rod 42 at these V shaped parts 94 and 96 allows lift bracket 46 to move freely along guide rod 42. The bearing surfaces may be lubricated to help ensure free movement.

One example sequence of operation of lift 24 will now be described with reference to FIGS. 14-18. FIGS. 14 and 16 show lift bracket 46 in a raised, servicing position and in a lowered, printing position, respectively, with an optional spacer 100 retracted for smaller printhead to platen spacing. FIGS. 15 and 17 show lift bracket 46 in a raised, servicing position and in a lowered, printing position, respectively, with spacer 100 extended for a larger printhead to platen spacing. Each spacer 100 is mounted to a corresponding lift bracket 46, 48 such that it can be extended into an operative position over stops 38, 40, as shown in FIGS. 15 and 17, or retracted out of the way as shown in FIGS. 14 and 16. Alternatively, each spacer 100 could be mounted to print bar 12. FIG. 18 is a more detailed view from the front of print bar 12 showing the areas of contact between stop 38 and print bar first end 50 and spacer 100. Although only once side of lift 24 is shown, both sides are raised and lowered simultaneously through pinion shaft 62.

Referring to FIGS. 14 and 15, pinions 64 and 66 are driven clockwise on shaft 62 to simultaneously raise print bar 12 connected at each end 50, 52 to lift brackets 46, 48. Referring to FIGS. 16 and 17, pinions 64 and 66 are driven counterclockwise on shaft 62 to simultaneously lower print bar 12. Referring now also to FIG. 18, at the lower limit of travel shown in FIG. 16, with spacer 100 retracted, one or more datum reference surfaces 102 on each end of the print bar 12 engage mating datum reference surface(s) 104 on stops 38 and 40 to properly position the print bar for printing at a smaller printhead to platen spacing (PPS). The contact between datums 102 and 104 corresponding to FIG. 16 is indicated by line 106 in FIG. 18. At the lower limit of travel shown in FIG. 17, with spacer 100 extended, datum reference surface(s) 102 on each end of the print bar 12 engage mating datum reference surface(s) 108 on spacer 100 to properly position the print bar for printing, but at a larger printhead to platen spacing (PPS). The contact between datums 102 and 104 corresponding to FIG. 17 is indicated by line 110 in FIG. 18. Spacer 100 may be a single thickness, as shown, for only one PPS adjustment or spacer 100 may be stepped or wedge shaped to allow for multiple PPS adjustments.

Referring again to the schematic end views of FIGS. 8 and 9, print bar 12 in printer 10 includes printheads 112 spaced apart from a platen 114 carrying paper 14 or other print media at a desired PPS. The desired PPS in FIGS. 8 and 9, for example, may be a smaller PPS (i.e., without a spacer 100) or a larger PPS (i.e., with a spacer 100).

Referring again to FIGS. 4 and 5, in the example embodiment shown, an encoder 116 is used to help control lift 24. Encoder 116, for example, includes an encoder disk 118 that rotates with shaft 62 and a sensor 120 that senses markings or other indicia on disk 118. The data/signals from sensor 120 indicate characteristics of disk 118 such as position, speed and acceleration and, accordingly, the corresponding characteristics of print bar 12. This information may be used by printer controller 22 (FIG. 1) to control motor 54 to move print bar 12 to a desired position at a desired speed and acceleration. For example, it may be desirable when raising and lowering print bar 12 to accelerate and decelerate lift 24 slowly to avoid rocking lift brackets 46, 48 on rods 42, 44 (by overcoming the guide rod preload described above). For another example, information from encoder 116 allows controller 22 (FIG. 1) to accurately position print bar 12 at any location along its full range of travel on lift 24.

As noted above, the example embodiments shown in the Figures and described above do not limit the disclosure. Other embodiments are possible. For example, although guide rods 42, 44 are shown as having a round cross-section, they may be rectangular or any other suitable shape. Also, guide rods 42, 44 need not be vertical. While it is expected that guides rods 42, 44 will usually be oriented vertical and perpendicular to the long axis of print bar 12, rods 42, 44 may be disposed at other orientations. Accordingly, these and other forms, details and embodiments may be made without departing from the spirit and scope of the disclosure, which is defined in the following claims.

What is claimed is:

1. An assembly, comprising:

a print bar having a first end and a second end opposite the first end;

a lift including first and second guide rods oriented parallel to one another and perpendicular to an axis of the print bar across a print zone, the first end of the print bar slidably connected to the first guide rod and the second end of the print bar slidably connected to the second guide rod, and the lift configured to simultaneously move both ends of the print bar along the guide rods;

a motor; and a transmission that includes:

a first rack connected to the first end of the print bar;

a second rack connected to the second end of the print bar;

a single shaft operatively connected to the motor, the shaft oriented parallel to the print bar axis and extending between the first rack and the second rack;

a first pinion on the shaft for engaging the first rack; and a second pinion on the shaft for engaging the second rack simultaneously with the first pinion engaging the first rack.

2. The assembly of claim 1, wherein:

the print bar axis is a horizontal axis;

the guide rods are oriented vertically; and the lift is configured to simultaneously raise and lower both ends of the lift bar along the guide rods while maintaining the printbar in a horizontal orientation throughout the range of travel of the print bar up and down the guide rods.

3. The assembly of claim 1, wherein the lift also includes:

a first bracket slidable along the first guide rod, the first bracket carrying the first rack and connecting the first end of the print bar to the first guide rod; and a second bracket slidable along the second guide rod, the second bracket carrying the second rack and connecting the second end of the print bar to the second guide rod.

4. An assembly, comprising:

a print bar having a first end and a second end opposite the first end;

a lift including first and second guide rods oriented parallel to one another and perpendicular to an axis of the print bar across a print zone, the first end of the print bar slidably connected to the first guide rod and the second end of the print bar slidably connected to the second guide rod, and the lift configured to simultaneously move both ends of the print bar along the guide rods;

first and second brackets each slidably mounted to a corresponding guide rod such that the degree of motion of the brackets with respect to the guide rods is constrained in theta X and theta Y; and the first end of the print bar is connected to the first bracket at a first connection and the second end of the print bar connected to the second bracket at a second connection, the first end of the print bar unconstrained in theta Y at the first connection and the second end of the print bar unconstrained in theta X at the second connection.

5. The assembly of claim 4, further comprising a shaft operatively connected to the brackets for simultaneously moving both ends of the print bar, through the brackets, along the guide rods.

6. The assembly of claim 5, wherein the shaft comprises a single rotatable but translationally stationary shaft carrying two pinions each engaging a rack on a corresponding one of the brackets for simultaneously moving both ends of the print bar along the guide rods through the brackets.

7. The assembly of claim 6, further comprising:

a chassis supporting the guide rods and the shaft;

a first stationary stop supported on the chassis adjacent to the first end of the print bar;

a second stationary stop supported on the chassis adjacent to the second end of the print bar; and the stops defining a limit in the range of travel of the print bar along the guide rods corresponding to a print bar printing position.

8. The assembly of claim 7, wherein the stops constrain the print bar in Z and theta Y when the print bar is in the printing position.

9. An assembly, comprising:

a first guide rod;

a second guide rod spaced apart from and oriented parallel to the first guide rod;

a first bracket slidably mounted to the first guide rod and carrying a first rack;

a second bracket slidably mounted to the second guide rod and carrying a second rack;

a print bar having a first end connected to the first bracket at a first connection and a second end connected to the second bracket at a second connection;

a single shaft carrying two pinions, each pinion simultaneously engaging a corresponding one of the racks and each pinion rotatable with the shaft; and a motor operatively couple to the shaft for rotating the shaft.

10. The assembly of claim 9, further comprising:

a chassis supporting the guide rods and the shaft;

a first stationary stop supported on the chassis adjacent to the first end of the print bar;

a second stationary stop supported on the chassis adjacent to the second end of the print bar; and the stops defining a limit in the range of travel of h print bar along the guide rods corresponding to a print bar printing position.

11. The assembly of claim 10, wherein the stops constrain the print bar in Z and theta Y when the print bar is in the printing position.

12. The assembly of claim 9, further comprising:

a disk operatively coupled to the shaft, the disk having markings or other indicators thereon for determining a position, velocity, acceleration and/or other characteristic of the disk; and a sensor operatively coupled to the disk for sensing the indicators on the disk.

13. An assembly, comprising:

a chassis; and a lift supported by the chassis, the lift configured to hold a print bar so that a first end of the print bar is unconstrained in theta Y and a second end of the print bar is unconstrained in theta X and to raise and lower the print bar over a print zone such that both ends of the print bar move simultaneously.

14. The assembly of claim 13, further comprising a print bar held in the lift.

15. The assembly of claim 14, wherein the print bar held in the lift comprises:

a first end of the print bar connected to the lift at a first connection so that the first end of the print bar is unconstrained in theta Y; and a second end of the print bar connected to the lift at a second connection so that the second end of the print bar is unconstrained in theta X at the second connection.

* * * * *

UNITED STATES PATENT AND TRADEMARK OFFICE

CERTIFICATE OF CORRECTION

PATENT NO. : 8,353,566 B2
APPLICATION NO. : 12/885167
DATED : January 15, 2013
INVENTOR(S) : Jeffrey T Hendricks et al.

It is certified that error appears in the above-identified patent and that said Letters Patent is hereby corrected as shown below:

In the Claims

In column 8, line 12, in Claim 10, delete “h” and insert -- the --, therefor.

Signed and Sealed this
Eleventh Day of June, 2013

Teresa Stanek Rea

Teresa Stanek Rea
*Acting Director of the United States Patent and Trademark Office*